United States Patent [19]

Krieger et al.

[11] 4,155,375

[45] May 22, 1979

[54] MULTIPLE VALVE CONTROL DEVICE

[75] Inventors: Karl Krieger, Wuppertal; Horst Schürmann, Hattingen, both of Fed. Rep. of Germany

[73] Assignee: Hermann Hemscheidt Maschinenfabrik, Fed. Rep. of Germany

[21] Appl. No.: 798,132

[22] Filed: May 18, 1977

[30] Foreign Application Priority Data

May 19, 1976 [DE] Fed. Rep. of Germany ..... 2622285

[51] Int. Cl.[2] ..... F15B 11/08; E03B 3/10; F16K 1/00; F15B 11/16

[52] U.S. Cl. ..... 137/596.2; 137/549; 91/170 MP

[58] Field of Search ..... 91/170 MP; 137/596.2, 137/596, 881, 544, 549, 596.1

[56] References Cited

U.S. PATENT DOCUMENTS

| | | | |
|---|---|---|---|
| 2,258,295 | 10/1941 | Merz | 137/549 |
| 2,609,207 | 9/1952 | Sickle | 137/596.12 |
| 3,019,816 | 2/1962 | Larsen et al. | 137/596.12 |
| 3,272,084 | 9/1966 | Bolton et al. | 91/170 MP |
| 3,520,327 | 7/1970 | Claydon et al. | 137/596.2 |
| 3,906,994 | 9/1975 | Schön | 137/544 |

*Primary Examiner*—Martin P. Schwadron
*Assistant Examiner*—A. Michael Chambers
*Attorney, Agent, or Firm*—Berman, Aisenberg & Platt

[57] ABSTRACT

A multiple valve control device for use with a hydraulic walking mine-roof support frame, comprising a valve housing containing control valves which are disposed concentrically to a central axis around a central filter into which an axially-extending control-medium feed duct enters and from which radial bores extend in a star pattern towards the control valves, the said control valves, which are provided with valve pistons, being actuated via operating members from the valve-housing endface which is provided with a cover.

3 Claims, 2 Drawing Figures

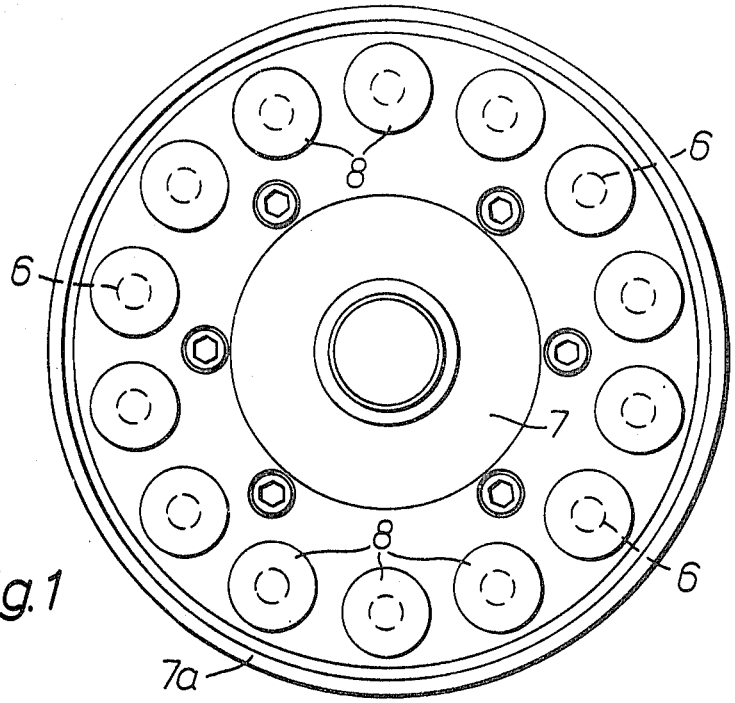
Fig. 1
Fig. 2
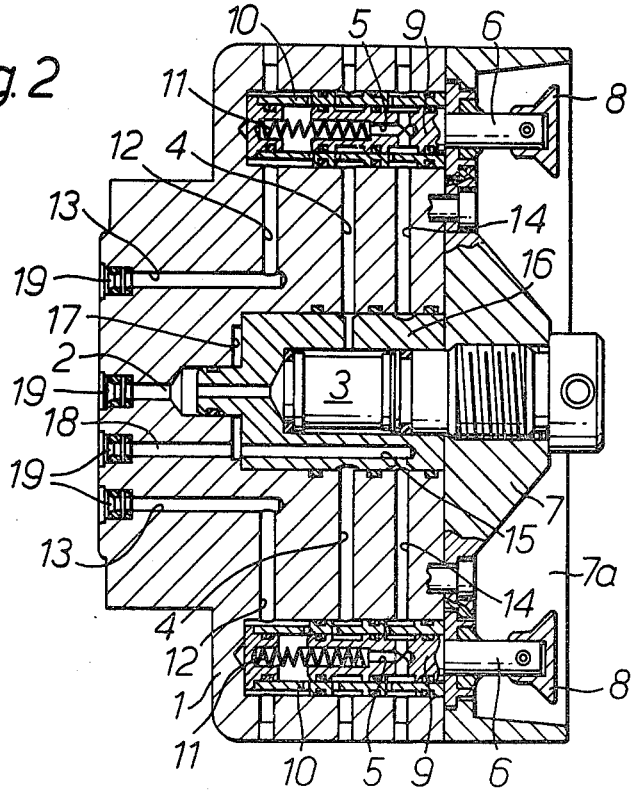

MULTIPLE VALVE CONTROL DEVICE

This invention relates to a multiple valve control device for use with a hydraulic walking mine-roof support frame for controlling a number of working valves which are disposed in the said frame and supply hydraulic cylinders thereof with pressure fluid, the control device comprising valves in a valve housing which alternately supply the working valves with a control medium via feed ducts and delivery ducts and return the medium in return ducts.

A known device for the remote-control of hydraulic mine-roof support frames is described in French published Specification No. 22 82 529. This device triggers the operation of the working valves of the hydraulic cylinders via a manually-actuated control device or pulse transmitter, using an automatic follow-up control device. Accordingly, the sequence can be triggered by a single control pulse transmitted from an adjacent frame, so that the individual operations for advancing the frame occur in a fixed sequence. Alternatively, the individual operations can be manually triggered separately, independently of the sequence, e.g., by using a known control device having a rotary spool as described in British Pat. No. 1,261,129. In this last-mentioned control device, the spool is rotatably mounted around a vertical shaft and is moved by a manual eccentric lever and extends via a baseplate comprising a central feed duct for the incoming pressure medium and a number of delivery ducts to the working valves, the delivery ducts being concentric with respect to the feed ducts. The feed duct is closed by a spring-loaded check valve in the rotary spool, which is opened by tilting the eccentric lever by means of a push rod acting on the check-valve seat. The check valve opens into an inner chamber of the rotary spool, containing a spring-loaded sleeve which, by rotating the spool with the eccentric lever, can be brought into line with one of the concentric delivery ducts and connected thereto in a sealing-tight manner. The rotary spool can be used for successively supplying each delivery duct with pressure fluid, and the individual delivery ducts can also be selected in any desired sequence by suitably rotating the eccentric lever.

According to another known proposal which is described in German Offenlegungsschrift No. 20 38 661, a control device constructed and operating in a substantially similar manner to that described above for manually actuating an adjacent support frame can be connected to an automatic device, and, as before, the control cycle of the automatic device can be adjusted at any time by the manual control means. The control valves are actuated by two servo-pistons with separate pressure chambers which are actuated by separate control lines, one piston being connected via a control line to the manually-actuated control device and the other piston being connected to a separate control circuit of the automatic control device. For example, a high-speed switching means can be used for simultaneously initiating the operation of advancing and retreating the mine-roof support frame.

Control devices of this kind are expensive and break down easily. Furthermore, the use of automatic follow-up control means is restricted to mineral deposits having a uniform geological structure. Accordingly, control devices comprising manually-actuated rotary spools are generally used only for directly controlling a neighbouring mine-roof support frame. However, unless additional circuitry is used, it is impossible to trigger only one control operation in each switch position, either with the previously-described control devices or in other known devices using rotary spools such as that shown in German Auslegeschriften Nos. 14 83 931; 15 50 310; and 22 25 296. If there is more than one switching operation, they have to be performed in succession, instead of simultaneously and in any desired sequence, and thus interrupt the previously initiated control process.

An aim of the present invention is to construct a particularly advantageous control device for controlling all the working valves of a walking mine-roof support frame, whereby any control operation can be triggered, either singly or together with other operations, and can be interrupted without dependence on other operations already in progress.

To this end, according to the invention, the control valves in the valve housing are disposed concentrically to a central axis around a central filter into which an axially-extending control-medium feed duct enters and from which radial bores extend in a star pattern towards the control valves, the said control valves, which are provided with valve pistons, being actuated via operating members from the valve-housing endface which is provided with a cover.

Advantageously, return bores extend radially from the control valves and flow into a central return duct via an annular duct and longitudinal bores of an inserted sleeve.

According to another preferred feature of the invention, the delivery ducts leading to the working valves are connected to the control valves by radial bores and are disposed concentrically with respect to the control-medium feed duct.

The control device of the invention provides a simple method of individually controlling the individual operations of a hydraulic walking mine-roof support frame from an adjacent frame, and the frame can be accurately retreated and adjusted. The frame is efficiently controlled, particularly under difficult geological conditions or in sloping coal-faces, because the control device operator can trigger a number of operations simultaneously and independently and, at all times, can directly adjust the motion of the frame.

The control device according to the invention will usually include a large number of control valves, so that a single control device can be used even for complicated frames performing a large number of hydraulically controlled operations. Since the control valves are concentric, the structure is compact and efficient and the valve-operating members are arranged in a clear manner. The device is space-saving and light in weight, so that it can therefore be incorporated at easily-accessible positions on the frame, thus helping the operator to monitor retreating movement of the frame. In special situations, the operator may also take the device out of its securing means and carry it about so as to control the frame from a different position.

If desired, the valve-housing endface remote from the valve-operating members can be constructed as a socket for a multiple plug connection and has connecting sockets or sleeves for individual plugs of a corresponding connecting fitting which is connected to the control-medium feed duct, the return duct, and the delivery ducts of the control valves. In this manner a multiple plug of a hose line comprising a number of individual hoses can be directly connected to the control device, resulting in simple, accident-proof assembly.

The invention will now be described in detail with reference to an embodiment thereof shown in the accompanying drawing, in which:

FIG. 1 shows the endface of the portable control unit; and

FIG. 2 is a cross-section through half of the multiple control device.

A control medium, e.g. an oil-in-water emulsion at a pressure below the working pressure, enters the control device through an axial feed duct 2 extending along the central axis of the valve housing 1 and flows into a centrally-disposed filter 3 in which impurities are held back. Radial bores 4 extend outwards in a star pattern from filter 3 towards a total of fourteen control valves 5 disposed concentrically with respect to the central axis. The valves are actuated by tripping pins or rods 6 mounted in a cover 7 on an endface of housing 1. Press-buttons 8 on the pins 6 are protected by a projecting outer edge *7a* of cover 7, thus substantially preventing accidental operation of the tripping pins 6.

Each control valve 5 comprises a piston 9 which, via its respective pin 6, is pushed along a guide sleeve 10 into the open position and is brought back to the closed position by a spring 11. In the open positions (not shown) the flow medium travels through annular ducts and bores (not shown) into the guide sleeve 10 via piston 9 to the corresponding, radially-extending delivery bore 12 and thence to the appropriate, axially-extending discharge duct 13. In this manner, all the concentrically-disposed ducts 13 extending from the control valve are connected to the control-medium feed duct 2.

In the closed position shown, ducts 12 and 13 are connected to the radial bores 14 which open into longitudinal bores 15 of a sleeve 16, and are also connected via an annular duct 17 to a central return duct 18. Ducts, 2, 18 and 13 end in connecting sleeves 19 in a recessed endface of housing 1 which is constructed as a socket for a multiple plug comprising individual plugs (not shown) which are simultaneously introduced into sockets 19.

We claim:

1. A multiple valve control device for use with a hydraulic walking mine-roof support frame, the device serving to control a number of working valves incorporated in the said frame and supplying pressurized hydraulic fluid to hydraulic cylinders of the frame, the said device comprising: a valve housing, a multiplicity of control valves arranged in a circle in said valve housing, a plurality of discharge ducts extending within and axially of the valve housing from a first end-face thereof, a plurality of radially-extending delivery bores in said valve housing communicating with said control valves and with said discharge ducts, a plurality of radially-extending return bores in said valve housing also communicating with said control valves, a filter disposed centrally in said valve housing with said control valves being disposed concentrically around said central filter, an axially-extending control medium feed duct leading from said first end-face of the valve housing to said filter, a plurality of radial bores extending in a star pattern from said filter to said control valves, a generally central return duct extending within and longitudinally of the valve housing from said first end-face of the valve housing and communicating with said return bores, a valve piston for each control valve, a respective valve-operating member for each control valve, a second end-face of the valve housing adapted to support said valve-operating members, and a cover for said second end-face, said first end-face of the valve housing being constructed as a socket connection for a multiple plug connection whereby the control-medium feed duct, the return duct, and the discharge ducts serve as sockets to receive the individual plugs of the said plug connection.

2. A multiple valve control device according to claim 1, in which said return bores communicate with said generally central return duct via an annular duct and longitudinal bores in a sleeve surrounding said filter.

3. A multiple valve control device according to claim 1, in which the control-medium feed duct, the return duct and the discharge ducts terminate at said first end-face of the valve housing in sleeves serving as plug-receiving sockets.

* * * * *